US006846553B2

(12) United States Patent
Haataja et al.

(10) Patent No.: US 6,846,553 B2
(45) Date of Patent: Jan. 25, 2005

(54) WOOD STRAND MOLDED PARTS SALTED WITH FINES TO IMPROVE MOLDING DETAIL, AND METHOD OF MAKING SAME

(75) Inventors: Bruce A. Haataja, Lake Linden, MI (US); John Quinn, Atlantic Mine, MI (US); Blair Froseth, Hancock, MI (US)

(73) Assignee: GFP Strandwood Corp., Hancock, MI (US)

( * ) Notice: Subject to any disclaimer, the term of this patent is extended or adjusted under 35 U.S.C. 154(b) by 0 days.

(21) Appl. No.: 10/472,093

(22) PCT Filed: Mar. 14, 2001

(86) PCT No.: PCT/US01/08075

§ 371 (c)(1),
(2), (4) Date: May 7, 2004

(87) PCT Pub. No.: WO02/074509

PCT Pub. Date: Sep. 26, 2002

(65) Prior Publication Data

US 2004/0191553 A1 Sep. 30, 2004

(51) Int. Cl.[7] ..... B27N 5/00

(52) U.S. Cl. ..... 428/292.4; 264/112; 264/113; 264/119

(58) Field of Search ..... 264/112, 113, 264/119, 109; 428/292.4

(56) References Cited

U.S. PATENT DOCUMENTS

| | | | | |
|---|---|---|---|---|
| 3,164,511 | A | 1/1965 | Elmendorf | |
| 3,238,281 | A | 3/1966 | Kato | |
| 3,354,248 | A | 11/1967 | Haas et al. | |
| 4,131,705 | A | 12/1978 | Kubinsky | 428/106 |
| 4,213,928 | A | 7/1980 | Casselbrant | 264/113 |
| 4,241,133 | A | 12/1980 | Lund et al. | 428/326 |
| 4,246,310 | A | 1/1981 | Hunt et al. | 428/106 |
| 4,248,163 | A | 2/1981 | Caughey | 108/53.3 |
| 4,248,820 | A | 2/1981 | Haataja | 264/113 |
| 4,337,710 | A | 7/1982 | Haataja et al. | 108/53.3 |
| 4,384,019 | A | 5/1983 | Haataja | 428/106 |
| 4,408,544 | A | 10/1983 | Haataja | 108/53.3 |
| 4,440,708 | A | 4/1984 | Haataja et al. | 264/109 |
| 4,469,216 | A | 9/1984 | Haataja et al. | 198/382 |
| 4,790,966 | A | 12/1988 | Sandberg et al. | 264/39 |
| 4,960,553 | A | 10/1990 | DeBruine et al. | 264/113 |

*Primary Examiner*—Mary Lynn Theisen
(74) *Attorney, Agent, or Firm*—Price, Heneveld, Cooper, DeWitt & Litton, LLP

(57) ABSTRACT

A to be molded wood flake (12) or strand part is shown, having sharp definition in a bend in the part. The method of making such part includes using fines (13) to sharply define the bends of the part.

18 Claims, 2 Drawing Sheets

WOOD STRAND MOLDED PARTS SALTED WITH FINES TO IMPROVE MOLDING DETAIL, AND METHOD OF MAKING SAME

BACKGROUND OF THE INVENTION

A. Field of the Invention

The present invention relates to wood flake molding.

B. Background of the Art

Wood flake molding, also referred to as wood strand molding, is a technique invented by wood scientists at Michigan Technological University during the latter part of the 1970s for molding three-dimensionally configured objects out of binder coated wood flakes having an average length of about 1¼ to about 6 inches, preferably about 2 to about 3 inches; an average thickness of about 0.005 to about 0.075 inches, preferably about 0.015 to about 0.030 inches; and an average width of 3 inches or less, most typically 0.25 to 1.0 inches, and never greater than the average length of the flakes. These flakes are sometimes referred to in the art as "wood strands." This technology is not to be confused with oriented strand board technology (see e.g., U.S. Pat. No. 3,164,511 to Elmendorf) wherein binder coated flakes or strands of wood are pressed into planar objects. In wood flake or wood strand molding, the flakes are molded into three-dimensional, i.e., non-planar, configurations.

Typically, in the prior technology, fines (wood particles passing through a ¼" screen) were discarded from the wood flakes. Fines have generally been considered as undesirable components of composition board products. Fines are generally believed to rob the binder from the larger wood flakes when they are coated together, resulting in poorly bonded products.

In wood flake molding, flakes of wood having the dimensions outlined above are coated with MDI or similar binder and deposited onto a metal tray having one open side, in a loosely felted mat, to a thickness eight or nine times the desired thickness of the final part. The loosely felted mat is then covered with another metal tray, and the covered metal tray is used to carry the mat to a mold. (The terms "mold" and "die", as well as "mold die", are sometimes used interchangeably herein, reflecting the fact that "dies" are usually associated with stamping, and "molds" are associated with plastic molding, and molding of wood strands does not fit into either category.) The top metal tray is removed, and the bottom metal tray is then slid out from underneath the mat, to leave the loosely felted mat in position on the bottom half of the mold. The top half of the mold is then used to press the mat into the bottom half of the mold at a pressure of approximately 600 psi, and at an elevated temperature, to "set" (polymerize) the MDI binder, and to compress and adhere the compressed wood flakes into a final three-dimensional molded part. The excess perimeter of the loosely felted mat, that is, the portion extending beyond the mold cavity perimeter, is pinched off where the part defining the perimeter of the upper mold engages the part defining perimeter of the lower mold cavity. This is sometimes referred to as the pinch trim edge.

U.S. Pat. Nos. 4,440,708 and 4,469,216 disclose this technology. The drawings in U.S. Pat. No. 4,469,216 best illustrate the manner in which the wood flakes are deposited to form a loosely felted mat, though the metal trays are not shown. By loosely felted, it is meant that the wood flakes are simply lying one on top of the other in overlapping and interleaving fashion, without being bound together in any way. The binder coating is quite dry to the touch, such that there is no stickiness or adherence which holds them together in the loosely felted mat. The drawings of U.S. Pat. No. 4,440,708 best illustrate the manner in which a loosely felted mat is compressed by the mold halves into a three-dimensionally configured article (see FIGS. 2–7, for example).

This is a different molding process as compared to a molding process one typically thinks of, in which some type of molten, semi-molten or other liquid material flows into and around mold parts. Wood flakes are not molten, are not contained in any type of molten or liquid carrier, and do not "flow" in any ordinary sense of the word. Hence, those of ordinary skill in the art do not equate wood flake or wood strand molding with conventional molding techniques.

One limitation in prior wood strand molding technology was difficulty in molding wood strand parts having sharp definition, i.e., a sharp radius of curvature in portions of the part. If the radius of curvature of the outside surface of the part is less than the part thickness, the outside surface of the final part tends to be ragged. Thus, it has not been possible to form wood strand molded parts with portions of sharp definition.

SUMMARY OF THE INVENTION

In the present invention, salting selective areas of the wood strand mat with resinated fines (very small pieces of wood) results in a sharper definition to the salted area of the compressed formed part. These and other features, advantages and objects of the present invention will be further understood and appreciated by those skilled in the art by reference to the following specification and claims.

DETAILED DESCRIPTION OF THE PREFERRED EMBODIMENTS

Figure 1:
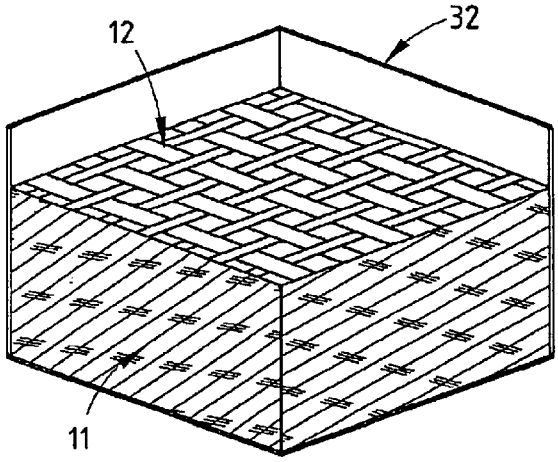
FIG. 1 is a side elavational cross-sectional view of a mat of wood flakes.

For purposes of description herein, the terms "upper," "lower," "right," "left," "rear," "front," "vertical," "horizontal," and derivatives thereof shall relate to the invention as orientated in the drawings. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
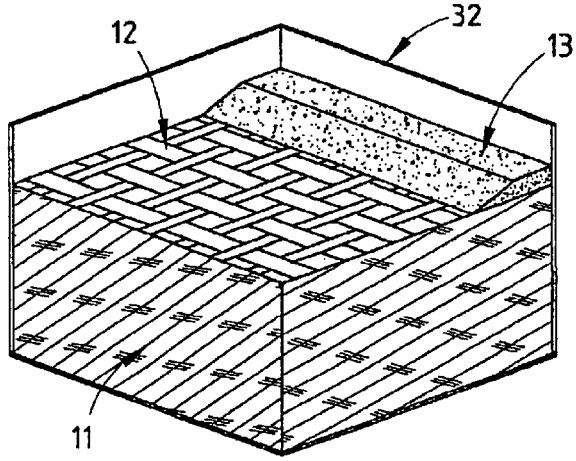
FIG. 2 is a side elavational cross-sectional view of the mat of FIG. 1 with fines added to a strategic location.

A loosely felted mat 11 of wood flakes 12 is formed in a caul bin or tray 32 (FIG. 1). The loosely felted mat 11 of wood flakes 12 is salted with fines 13 in the areas where sharp definition of a curve or bend in the part 14 is desired (FIG. 2). The fines 13 in the illustrated example are salted onto the loosely felted mat 11 when the loosely felted mat is the caul bin or tray 32. However, the salting of the fines 13 may take place after the loosely felted mat 11 of wood flakes 12 of is placed in the mold 10.

Figure 5:
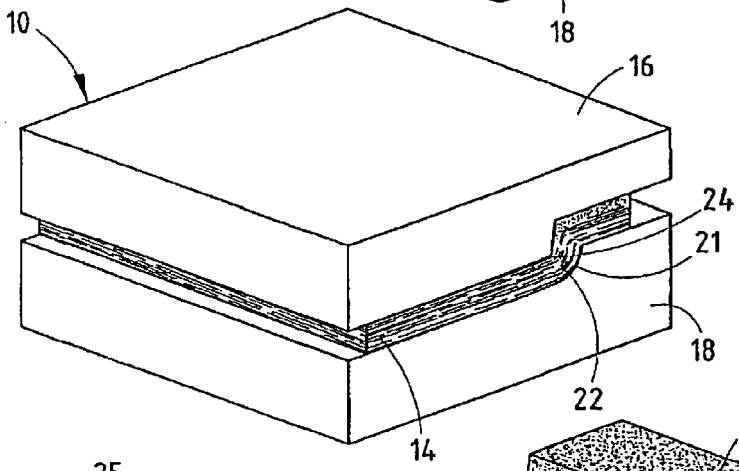
FIG. 5 is a side elavational view of the mold of FIG. 3 compressed when fines have been added to the felted mat.
Figure 6:
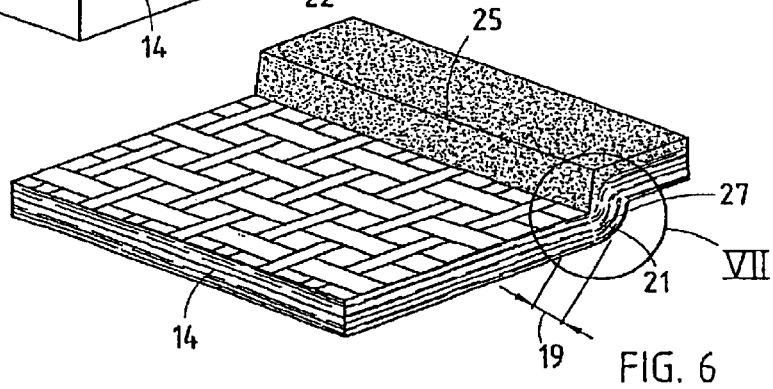
FIG. 6 is a side elavational view of the part once removed from the mold of FIG. 3 when fines have been added to the mat.

The mold 10 (FIG. 3) is used to compress a loosely felted mat 11 of wood flakes 12 and fines 13 into a molded wood flake part 14 (FIGS. 5 and 6). The mold 10 includes a top mold die 16 and a bottom mold die 18. The top mold die 16 includes a surface 20, and the bottom mold die 18 includes a surface 26. The surface 20 of the top mold die 16 and the surface 26 of the bottom mold die 18 define a cavity 30 therebetween. The surface 26 of the bottom mold die 18 has a bend forming portion 22, while the surface 20 of the top mold die 16 has a corresponding bend forming portion 24.

Figure 7:
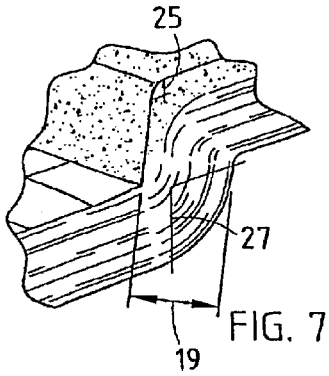
FIG. 7 is an enlarged view of area VII of FIG. 6.

The usual design for bends in molded wood flake parts 14 is to have the outside radius 25 of the part 14 in the area of the bend 21 to be equal to the inside radius 27 of the part 14 at the bend 21 plus the thickness 19 of the part 14 (FIGS. 6,7). If the outside radius 25 of the part 14 is zero or less than thickness 19 of the part 14, then the wood flakes 12 do not compact well in the bend 21, resulting in a ragged look and low density because of the random alignment of the wood flakes 12. When the loosely felted mat 11 is salted with fines 13 in the area where the bend 21 is to be formed in the part 14, the fines 13 provide the necessary mass to maintain density and prevent a ragged look in the part 14.

Figure 3:
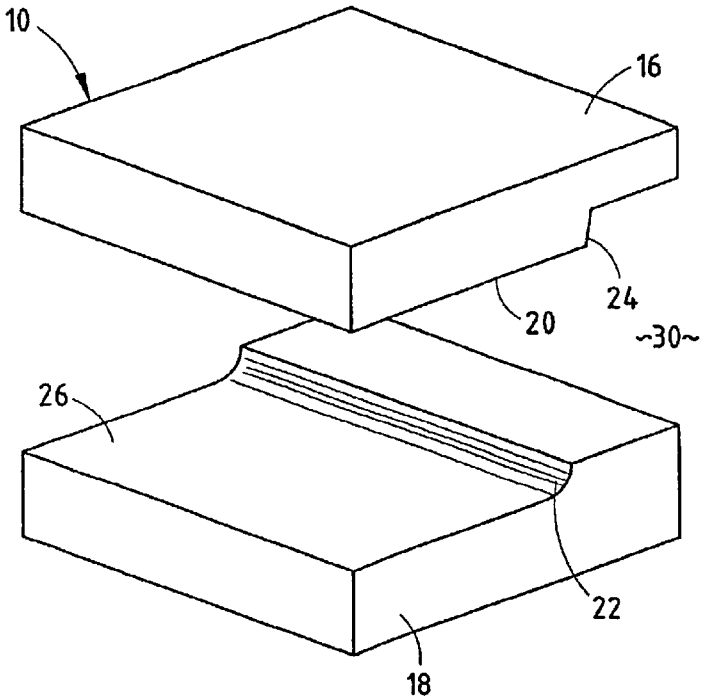
FIG. 3 is a side elavational cross-sectional view of spaced upper and lower halves where a part with a bend(s) or curve(s) is to be formed.
Figure 4:
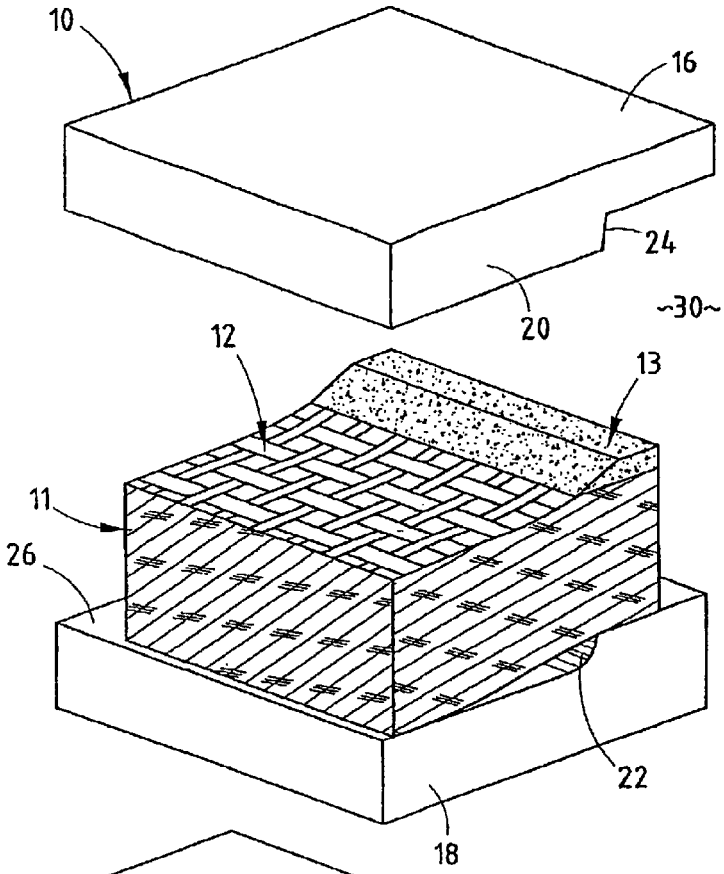
FIG. 4 is the same view of FIG. 3, with a loosely felted mat of wood flakes that has been salted with fines positioned between the mold halves.

In the illustrated example, the molded wood flake part 14 is made by positioning a loosely felted mat 11 of wood flakes 12 and fines 13 on the bottom mold die 18 (FIG. 3). The top mold die 16 and the bottom mold die 18 are then brought together and heat and pressure are applied to the felted mat 11. The felted mat 11 is thereby compressed and cured into the molded wood flake part 14 (FIG. 4). The wood flake part 14 that is formed has a sharp outside radius 25 where the fines 13 were added (FIGS. 6, 7).

The wood flakes 12 used in creating the molded wood flake part 14 can be prepared from various species of suitable hardwoods and softwoods used in the manufacture of particleboard. Representative examples of suitable woods include aspen, maple, oak, elm, balsam fir, pine, cedar, spruce, locust, beech, birch and mixtures thereof. Aspen is preferred.

Suitable wood flakes 12 can be prepared by various conventional techniques. Pulpwood grade logs, or so-called round wood, are converted into wood flakes 12 in one operation with a conventional roundwood flaker. Logging residue or the total tree is first cut into fingerlings in the order of 2–6 inches long with a conventional device, such as the helical comminuting shear disclosed in U.S. Pat. No. 4,053,004, and the fingerlings are flaked in a conventional ring-type flaker. Roundwood wood flakes 12 generally are higher quality and produce stronger parts because the lengths and thickness can be more accurately controlled. Also, roundwood wood flakes 12 tend to be somewhat flatter, which facilitates more efficient blending and the logs can be debarked prior to flaking which reduces the amount of less desirable fines produced during flaking and handling. Acceptable wood flakes 12 can be prepared by ring flaking fingerlings. This technique is more readily adaptable to accept wood in poorer form, thereby permitting more complete utilization of certain types of residue and surplus woods.

Irrespective of the particular technique employed for preparing the wood flakes 12, the size distribution of the wood flakes 12 is quite important, particularly the length and thickness. The wood flakes should have an average length of about 1¼ inch to about 6 inches and an average thickness of about 0.005 to about 0.075 inches. The average length of the wood flakes is preferably about 2 to about 3 inches. In any given batch, some of the wood flakes 12 can be shorter than 1¼ inch, and some can be longer than 6 inches, so long as the overall average length is within the above range. The same is true for the thickness.

The presence of major quantities of wood flakes 12 having a length shorter than about 1¼ inch tends to cause the felted mat 11 to pull apart during the molding step. The presence of some fines in the felted mat 11 produces a smoother surface and, thus, may be desirable for some applications so long as the majority of the wood flakes, preferably at least 75%, is longer than 1⅛ inch and the overall average length is at least 1¼ inch.

Substantial quantities of wood flakes 12 having a thickness of less than about 0.005 inches should be avoided, because excessive amounts of binder are required to obtain adequate bonding. On the other hand, wood flakes 12 having a thickness greater than about 0.075 inch are relatively stiff and tend to overlie each other at some incline when formed into the felted mat 11. Consequently, excessively high mold pressures are required to compress the wood flakes 12 into the desired intimate contact with each other. For wood flakes 12 having a thickness falling within the above range, thinner ones produce a smoother surface while thick ones require less binder. These two factors are balanced against each other for selecting the best average thickness for any particular application. The average thickness of the wood flakes 12 preferably is about 0.015 to about 0.25 inches, and more preferably about 0.0020 inch.

The width of the wood flakes 12 is less important. The wood flakes 12 should be wide enough to ensure that they lie substantially flat when felted during mat formation. The average width generally should be about 3 inches or less and no greater than the average length. For best results, the majority of the wood flakes 12 should have a width of about 1/16 inch to about 3 inches, and preferably 0.25 to 1.0 inches.

The blade setting on a flaker can primarily control the thickness of the wood flakes 12. The length and width of the wood flakes 12 are also controlled to a large degree by the flaking operation. For example, when the wood flakes 12 are being prepared by ring flaking fingerlings, the length of the fingerlings generally sets the maximum lengths. Other factors, such as the moisture content of the wood and the amount of bark on the wood affect the amount of fines produced during flaking. Dry wood is more brittle and tends to produce more fines. Bark has a tendency to more readily break down into fines during flaking and subsequent handling than wood.

While the flake size can be controlled to a large degree during the flaking operation as described above, it usually is necessary to use some sort of classification in order to remove undesired particles, both undersized and oversized, and thereby ensure the average length, thickness and width of the wood flakes 12 are within the desired ranges. When roundwood flaking is used, both screen and air classification usually are required to adequately remove both the undersize and oversize particles, whereas fingerling wood flakes 12 usually can be properly sized with only screen classification.

Wood flakes 12 from some green wood can contain up to 90% moisture. The moisture content of the mat must be substantially less for molding as discussed below. Also, wet wood flakes 12 tend to stick together and complicate classification and handling prior to blending. Accordingly, the wood flakes 12 are preferably dried prior to classification in a conventional type drier, such as a tunnel drier, to the moisture content desired for the blending step. The moisture content to which the wood flakes 12 are dried usually is in the order of about 6 weight % or less, preferably about 2 to about 5 weight %, based on the dry weight of the wood flakes 12. If desired, the wood flakes 12 can be dried to a moisture content in the order of 10 to 25 weight % prior to classification and then dried to the desired moisture content for blending after classification. This two-step drying may reduce the overall energy requirements for drying wood flakes 12 prepared from green woods in a manner producing substantial quantities of particles which must be removed during classification and, thus, need not be as thoroughly dried.

Fines 13 can be made from the same wood used to form the wood flakes 12. The primary way of obtaining fines 13 is by collecting those pieces of wood which pass through a 0.25" screen (i.e., a plate with a plurality of 0.25" diameter openings). In some cases, long thin strands of wood may pass through the 0.25" screen, but in most cases, the strands that pass through will have a thickness of 0.25" or less and an area of less than 0.05 inches. However, with respect to the present invention, the term "fines" in the broader, more generically relative sense defines wood particles having an average width and thickness several times smaller than the average width or thickness of the wood flakes 12.

Another way of obtaining fines 13 is by collecting already coated fines 13 of appropriate size that separate from the wood flakes 12 after the wood flakes 12 have been coated. Some fines may not be collected through the screening process, and instead ride along with the larger wood strands to the coating process. Once the wood flakes 12 are coated, the fines 13 may separate out from the wood flakes 12. Fines 13 have a tendency to separate from the wood flakes 12 while the wood flakes are moved, for example, along a conveyor belt or when run over another screen. Thus, these fines that are collected from the already coated wood flakes 12 do not need to be coated with resin, unlike fines that are obtained from the screen containing 0.25" diameter holes, prior to coating the wood flakes 12.

To coat the wood flakes 12 and fines 13 prior to being placed as a felted mat 11 within the cavity 30 within the mold 10, a known amount of the dried, classified wood flakes 12 and fines 13 is introduced into a conventional blender, such as a paddle-type batch blender, wherein predetermined amounts of a resinous particle binder, and optionally a wax and other additives, is applied to the wood flakes 12 and fines 13 as they are tumbled or agitated in the blender. The fines 13 obtained from the screening process should be coated separately from the wood flakes 12. Suitable binders include those used in the manufacture of particle board and similar pressed fibrous products and, thus, are referred to herein as "resinous particle board binders." Representative examples of suitable binders include thermosetting resins such as phenolformaldehyde, resorcinol-formaldehyde, melamine-formaldehyde, urea-formaldehyde, urea-furfuryl and condensed furfuryl alcohol resins, and organic polyisocyantes, either alone or combined with urea- or melamine-formaldehyde resins.

Particularly suitable polyisocyanates are those containing at least two active isocyanate groups per molecule, including diphenylmethane diisocyanates, m- and p-phenylene diisocyanates, chlorophenylene diisocyanates, toluene di- and triisocyanates, triphenylmethene triisocyanates, diphenylether-2,4,4'-triisoccyanate and polyphenylpolyisocyanates, particularly diphenylmethane-4,4'-diisocyanate. So-called MDI is particularly preferred.

The amount of binder added to the wood flakes 12 and fines 13 during the blending step depends primarily upon the specific binder used, size, moisture content and type of the wood flakes 12 and fines 13, and the desired characteristics of the part being formed. Generally, the amount of binder added to the wood flakes 12 and fines 13 is about 2 to about 15 weight %, preferably about 4 to about 10 weight %, as solids based on the dry weight of the wood flakes 12 and fines 13. When a polyisocyanate is used alone or in combination with a urea-formaldehyde resin, the amounts can be more toward the lower ends of these ranges.

The binder can be admixed with the wood flakes 12 and fines 13 in either dry or liquid form. To maximize coverage of the wood flakes 12 and fines 13, the binder preferably is applied by spraying droplets of the binder in liquid form onto the wood flakes 12 and fines 13 as they are being tumbled or agitated in the blender. When polyisocyantes are used, a conventional mold release agent preferably is applied to the die or to the surface of the felted mat prior to pressing. To improve water resistance of the part, a conventional liquid wax emulsion preferably is also sprayed on the wood flakes 12 and fines 13 during the blinding step. The amount of wax added generally is about 0.5 to about 2 weight %, as solids based on the dry weight of the wood flakes 12 and fines 13. Other additives, such as at least one of the following: a coloring agent, fire retardant, insecticide, fungicide, mixtures thereof and the like may also be added to the wood flakes 12 and fines 13 during the blending step. The binder, wax and other additives, can be added separately in any sequence or in combined form.

The moistened mixture of binder, wax and wood flakes 12 or "furnish" from the blending step is formed into a loosely-felted, layered mat 11, which is placed within the cavity 30 prior to the molding and curing of the felted mat 11 into molded wood flake part 14. The moisture content of the wood flakes 12 and fines 13 should be controlled within certain limits so as to obtain adequate coating by the binder during the blending step and to enhance binder curing and deformation of the wood flakes 12 and fines 13 during molding.

The presence of moisture in the wood flakes 12 and fines 13 facilitates their bending to make intimate contact with each other and enhances uniform heat transfer throughout the mat during the molding step, thereby ensuring uniform curing. However, excessive amounts of water tend to degrade some binders, particularly urea-formaldehyde resins, and generate steam which can cause blisters. On the other hand, if the wood flakes 12 and fines 13 are too dry, they tend to absorb excessive amounts of the binder, leaving an insufficient amount on the surface to obtain good bonding and the surfaces tend to cause hardening which inhibits the desired chemical reaction between the binder and cellulose in the wood. This latter condition is particularly true for polyisocyanate binders.

Generally, the moisture content of the furnish after completion of blending, including the original moisture content of the wood flakes 12 and fines 13 and the moisture added during blending with the binder, wax and other additives, should be about 5 to about 25 weight %, preferably about 8 to about 12 weight %. Generally, higher moisture contents within these ranges can be used for polyisocyanate binders because they do not produce condensation products upon reacting with cellulose in the wood.

The furnish is formed into the generally flat, loosely-felted, mat 11, preferably as multiple layers. A conventional dispensing system, similar to those disclosed in U.S. Pat. Nos. 3,391,223 and 3,824,058, and 4,469,216 can be used to form the felted mat 11. Generally, such a dispensing system includes trays 32, each having one open side, carried on an endless belt or conveyor and one or more (e.g., three) hoppers spaced above and along the belt in the direction of travel for receiving the furnish.

When a multi-layered felted mat 11 is formed, a plurality of hoppers usually are used with each having a dispensing or forming head extending across the width of the carriage for successively depositing a separate layer of the furnish as the tray 32 is moved beneath the forming heads. Following this, the tray 32 is taken to the mold to place the felted mat 11 within the cavity of bottom mold, by sliding the tray out from under the mat. The fines 13 are salted in the portions of the mat 11 where the sharp definition of a bend or curve is desired in the molded wood flake part 14. Alternatively, the salting of the fines 13 may take place in the appropriate areas when the multi-layered felted mat is in the tray 32, prior to being placed on the mold (FIG. 1).

In order to produce molded wood flake parts 14 having the desired edge density characteristics without excessive blistering and springback, the felted mat should preferably have a substantially uniform thickness and the wood flakes 12 should lie substantially flat in a horizontal plane parallel to the surface of the carriage and be randomly oriented relative to each other in that plane. The uniformity of the mat thickness can be controlled by depositing two or more layers of the furnish on the carriage and metering the flow of furnish from the forming heads.

Spacing the forming heads above the carriage so the wood flakes 12 must drop about 1 to about 3 feet from the heads en route to the carriage can enhance the desired random orientation of the wood flakes 12. As the flat wood flakes 12 fall from that height, they tend to spiral downwardly and land generally flat in a random pattern. Wider wood flakes 12 within the range discussed above enhance this action. A scalper or similar device spaced above the carriage can be used to ensure uniform thickness or depth of the mat, however, such means usually tend to align the top layer of wood flakes 12, i.e., eliminate the desired random orientation. Accordingly, the thickness of the mat that would optimally have the nominal part thickness 100 preferably controlled by closely metering the flow of furnish from the forming heads. The mat thickness that would optimally have the nominal part thickness 100 used will vary depending upon such factors as the size and shape of the wood flakes 12, the particular technique used for forming the mat 11, the desired thickness and density of the molded wood flake part 14 produced, the configuration of the molded wood flake part 14, and the molding pressure to be used. Further, the fines 13 are salted in the appropriate portions of the mat 11 where the sharp definition of a bend or curve is desired in the wood flake part 14.

Following the production of the felted mat 11 and placement of the felted mat 11 within the cavity 30 of the mold 10, the felted mat 11 mat is compressed and cured under heat and pressure when the top mold die 16 engages the bottom mold die 18.

The felted mat 11, compressed and cured between the top mold die 16 and the bottom mold 18, becomes the molded wood flake part 14. The bend forming portion 22 of the bottom surface 26 and the bend forming portion 24 of the top mold die 16 form the bend in the part 14. After the molded wood flake part 14 is produced by the method of the present invention, any flashing is removed by conventional means.

The resulting wood flake part 14 has a sharply defined outside radius 25 in the bend 21 where the fines 13 are placed in the mat 11. The fines 13 may be placed at any portion of the mat 11 where sharp definition of a bend 21 in the wood flake molded part 14 is desired.

The above description is that of the preferred embodiment only. Modifications of the invention will occur to those skilled in the art and to those who make or use the invention. Therefore, it is understood that the embodiment described above is merely for illustrative purposes and not intended to limit the scope of the invention, which is defined by the following claims as interpreted according to the principles of patent law, including the Doctrine of Equivalents.

What is claimed is:

1. A method of molding a three dimensionally shaped article with sharp definition, from binder coated wood flakes, comprising:

forming a loosely felted mat of said wood flakes;

salting said loosely felted mat with resinated fines in areas where sharp definition of said article is desired;

depositing said mat onto a lower mold die;

compressing and heating said mat between an upper mold die and said lower mold die.

2. The method of claim 1, wherein said fines are placed on said loosely felted mat where a bend is to be formed in said article.

3. The method of claim 1, wherein said wood flakes have an average length of from about 1¼ to about 6 inches, an average thickness of from about 0.015 to about 0.25 inches, and an average width of less than the average length, and no greater than about 3 inches.

4. The method of claim 3, wherein said fines can pass through a 0.25" diameter screen.

5. The method of claim 1, wherein said wood flakes of said mat have an average length of from about 2 to about 3 inches.

6. The method of claim 5, wherein said wood flakes of said mat have an average thickness of from about 0.015 to about 0.025 inches.

7. The method of claim 6, wherein said wood flakes of said mat have an average width of from about 0.25 to about 1.0 inches.

8. The method of claim 7, wherein said fines can pass through a 0.25" diameter screen.

9. The method of claim 1, wherein said fines can pass through a 0.25" diameter screen.

10. A three dimensional article of manufacture with a sharp definition formed from binder coated wood flakes, wherein said wood flakes are formed into a loosely felted mat which is further deposited onto a lower mold die;

wherein said mat is salted with fines in areas where sharp definition is desired;

wherein said mat is compressed and heated between an upper mold die and said lower mold die.

11. The article of manufacture of claim 10, wherein said fines are placed on said loosely felted mat where a bend is to be formed in said article.

12. The article of claim 10, wherein said wood flakes have an average length of from about 1¼ to about 6 inches, an average thickness of from about 0.015 to about 0.25 inches, and an average width of less than the average length, and no greater than about 3 inches.

13. The article of claim 12, wherein said fines can pass through a 0.25" diameter screen.

14. The article of claim 10, wherein said wood flakes of said mat have an average length of from about 2 to about 3 inches.

15. The article of claim 14, wherein said wood flakes of said mat have an average thickness of from about 0.015 to about 0.025 inches.

16. The article of claim 15, wherein said wood flakes of said mat have an average width of from about 0.25 to about 1.0 inches.

17. The article of claim 16, wherein said fines can pass through a 0.25" diameter screen.

18. The article of claim 10, wherein said fines can pass through a 0.25" diameter screen.

* * * * *